US009803446B2

(12) United States Patent
Lyle et al.

(10) Patent No.: US 9,803,446 B2
(45) Date of Patent: Oct. 31, 2017

(54) LOCKDOWN MECHANISM AND LOCKDOWN SYSTEM FOR WELLHEAD CONNECTOR

(71) Applicant: Vetco Gray Inc., Houston, TX (US)

(72) Inventors: Rockford Dee Lyle, Houston, TX (US); Irving Jair Villasenor, Queretaro (MX); Viviana Resendiz, Queretaro (MX); Sergio Romero, Queretaro (MX)

(73) Assignee: VETCO GRAY INC., Houston, TX (US)

( * ) Notice: Subject to any disclaimer, the term of this patent is extended or adjusted under 35 U.S.C. 154(b) by 24 days.

(21) Appl. No.: 14/864,991

(22) Filed: Sep. 25, 2015

(65) Prior Publication Data

US 2016/0090807 A1 Mar. 31, 2016

Related U.S. Application Data

(60) Provisional application No. 62/055,760, filed on Sep. 26, 2014.

(51) Int. Cl.
*E21B 17/02* (2006.01)
*E21B 33/038* (2006.01)
*E21B 19/00* (2006.01)

(52) U.S. Cl.
CPC ..... *E21B 33/038* (2013.01); *E21B 19/002* (2013.01)

(58) Field of Classification Search
CPC ..... E21B 17/085; E21B 19/002; E21B 33/038
See application file for complete search history.

(56) References Cited

U.S. PATENT DOCUMENTS 3,445,126 A * 5/1969 Watkins ..... E21B 17/00 285/111
4,057,267 A * 11/1977 Jansen, Jr. ..... F16L 37/002 285/18
4,433,859 A * 2/1984 Driver ..... E21B 33/038 285/315
4,453,745 A * 6/1984 Nelson ..... E21B 33/038 285/18
4,526,406 A * 7/1985 Nelson ..... E21B 33/038 285/18

(Continued)

FOREIGN PATENT DOCUMENTS

GB 2488648 A 9/2012

OTHER PUBLICATIONS

PCT Search Report and Written Opinion issued in connection with corresponding PCT Application No. PCT/US2015/052241 dated Feb. 22, 2016.

(Continued)

*Primary Examiner* — Matthew R Buck
(74) *Attorney, Agent, or Firm* — Hogan Lovells US LLP

(57) ABSTRACT

A mechanical lockdown system for a subsea wellhead connector includes a lockdown member or plate that engages with a tie rod that is connected to the wellhead assembly. The lockdown system includes a support member that is permanently secured to an annular ring through which the tie rod passes. The lockdown system also includes a first handle and a second handle that are installed using a plunger or spring loaded system such that mechanical lockdown system can be easily moved from a lockdown open position to a lockdown engaged position as and when desired with minimal ROV interface.

20 Claims, 7 Drawing Sheets

(56) References Cited

U.S. PATENT DOCUMENTS

| | | | | |
|---|---|---|---|---|
| 4,619,324 | A * | 10/1986 | Couch | E21B 33/038 166/340 |
| 5,593,249 | A | 1/1997 | Cox et al. | |
| 6,179,053 | B1 | 1/2001 | Dallas | |
| 6,666,272 | B2 | 12/2003 | Singeetham et al. | |
| 7,503,391 | B2 | 3/2009 | McCanna et al. | |
| 7,686,087 | B2 * | 3/2010 | Pallini | E21B 17/085 166/338 |
| 8,573,305 | B2 * | 11/2013 | Reddy | E21B 17/017 166/338 |
| 2006/0140726 | A1 | 6/2006 | Pollack et al. | |
| 2012/0267116 | A1 * | 10/2012 | Anderson | E21B 19/16 166/340 |
| 2014/0096977 | A1 | 4/2014 | Gette et al. | |
| 2014/0262307 | A1 | 9/2014 | Caldwell et al. | |

OTHER PUBLICATIONS

Skeels, H.B. "Development of a Novel Tieback Connector with High Mechanical Strength Capacity for Spar Floating Production Facilities and Their Production Risen"; Offshore Technology Conference, Houston, TX May 5-8, 1997, pp. 671-685.

Halkyard, J. "Large Spar Drilling and Production Platforms for Deep Water Oil and Gas", Springer Science+Business Media Singapore 2015, pp. 221-260.

* cited by examiner

LOCKDOWN MECHANISM AND LOCKDOWN SYSTEM FOR WELLHEAD CONNECTOR

CROSS-REFERENCE TO RELATED APPLICATIONS

This application claims priority to U.S. Provisional Patent Application No. 62/055,760 filed on Sep. 26, 2014, the entire contents of which are incorporated herein by reference.

TECHNICAL FIELD

This invention relates in general to subsea oil and gas well production, and in particular to a mechanical connector for connecting members to a subsea wellhead assembly.

BACKGROUND

A subsea wellhead assembly installed at the sea floor may be in water thousands of feet deep. During completion and certain production operations, components from a floating platform are lowered from the platform to engage the subsea wellhead assembly. A tieback connector generally connects a production riser between a subsea wellhead housing and the surface production platform. Typically, the tieback connector has locking elements that lock into a profile in the wellhead housing. A lockdown mechanism is sometimes used to resist upward movement of the tieback connector and prevent unintentional unlocking of the tieback connector that may occur due to thermal growth and external environmental forces during production.

Some current lockdown mechanism designs include multiple lockdown members that are spaced around the circumference of the lockdown mechanism. Installing the lockdown mechanism usually requires a remotely operated vehicle ("ROV") that manually manipulates a plate of each lockdown member with a grooved profile into engagement with a rod with a mating profile. In some subsea developments, the wells are located on a template, which provide limited access for a ROV and make it very difficult for the ROV to move around and between the wells to install the various lockdown members.

SUMMARY

The methods and systems of the current disclosure provide a mechanical lockdown system that can be easily operated and moved between a lockdown open position and a lockdown engaged position by an operator remotely from a surface location. The example methods and systems disclosed can be operated as many times as needed without the need for MLD components to be transported every time the connector assembly is locked and unlocked.

One example embodiment of the disclosure is a lockdown system for a subsea wellhead connector connecting a tubular member to a subsea wellhead assembly. The lockdown system includes a tie rod for extending in an axial direction from a stationary connector body of a tieback connector through a lockdown support member circumscribing the tubular member, the tie rod having a tie rod profile on a tie rod outer diameter, a lockdown member with an inner diameter profile corresponding to the tie rod profile, the lockdown member being moveable between a lockdown open position where the member is spaced radially outward from the tie rod, and a lockdown engaged position where the inner diameter profile engages the tie rod profile to axially couple the stationary connector body and the lockdown support member, and a lockdown member rod extending radially outward relative to an axis of the tie rod profile, the lockdown member rod adapted to move the lockdown member from the lockdown open position to the lockdown engaged position, wherein the lockdown member rod is supported by a lockdown member rod support that is adapted to be secured to the lockdown support member circumscribing the tubular member. The lockdown system also includes a first handle installed on one end of the lockdown member rod, the first handle being perpendicular to the lockdown member rod such that a radially outward movement of the first handle relative to the lockdown member rod support moves the lockdown member from the lockdown engaged position to the lockdown open position, and a lockdown member rod spring circumscribing the lockdown member rod, the lockdown member rod spring having a first end that engages the lockdown member and a second end that engages the lockdown member rod support, thereby biasing the lockdown member away from the lockdown member rod support. The lockdown system also includes a second handle having a stem that is inserted in a through bore formed parallel to the axis of the lockdown member; and a stopper located in a hole in the annular ring. The lockdown support member may include a stopper spring located in a port, wherein the stopper spring urges the stopper in an upward direction so that as the bore of the lockdown member passes over the port, the stopper spring urges the stopper into the bore.

Another example embodiment is a lockdown assembly for a subsea wellhead connector connecting a tubular member to a subsea wellhead assembly. The lockdown assembly includes a tie rod extending in an axial direction from a stationary connector body of a tieback connector through an annular ring circumscribing the tubular member, the tie rod having a tie rod profile on a tie rod outer diameter, a lockdown member with an inner diameter profile corresponding to the tie rod profile, the lockdown member being moveable between a lockdown open position where the member is spaced radially outward from the tie rod, and a lockdown engaged position where the inner diameter profile engages the tie rod profile to axially couple the stationary connector body and the annular ring, the lockdown member being slidable on the annular ring, and a rod extending radially outward from the lockdown member, the rod adapted to move the lockdown member from the lockdown open position to the lockdown engaged position, wherein the rod is supported by a rod support that is secured to the annular ring circumscribing the tubular member. The lockdown assembly also includes a first handle installed on one end of the rod, the first handle being perpendicular to the rod such that a radially outward movement of the first handle moves the lockdown member from the lockdown engaged position to the lockdown open position, and a rod spring circumscribing the rod, the rod spring having a first end that engages the lockdown member and a second end that engages the rod support, thereby biasing the lockdown member away from the rod support. The lockdown assembly also includes a second handle having a stem that is inserted in a through bore formed on one surface of the lockdown member, the stem having a stopper on a lower end of the stem. The annular ring may include a stopper spring located in a port, wherein the stopper spring urges the stopper in an upward direction so that as the bore of the lockdown member passes over the port, the stopper spring urges the stopper into the bore.

Another example embodiment is a method for connecting a tubular member to a subsea wellhead assembly having a tie rod extending along an axis from a stationary connector body of a tieback connector, the tie rod having a tie rod profile on a tie rod outer diameter. The method includes mounting an annular ring to the stationary connector body with the tie rod extending through the annular ring, mounting a lockdown member with an inner diameter profile corresponding to the tie rod profile on the annular ring, the lockdown member being moveable between a lockdown open position where the member is spaced radially outward from the tie rod, and a lockdown engaged position where the inner diameter profile engages the tie rod profile to axially couple the stationary connector body and the annular ring, extending a rod radially outward from the lockdown member, the rod adapted to move the lockdown member from the lockdown open position to the lockdown engaged position, wherein the rod is supported by a rod support that is secured to the annular ring circumscribing the tubular member, and pulling the rod radially outward to radially move the lockdown member relative to the annular ring. The method also includes providing a first handle on one end of the rod, the first handle being perpendicular to the rod such that a radially outward movement of the first handle moves the lockdown member from the lockdown engaged position to the lockdown open position, and providing a rod spring circumscribing the rod, the rod spring having a first end that engages the lockdown member and a second end that engages the rod support, thereby creating biasing the lockdown member away from the rod support. The method also includes inserting a stem of a second handle into a through bore formed on one surface of the lockdown member, the stem having a stopper on a lower end of the stem. The method also includes providing the annular ring with a hole configured to receive a stopper spring, wherein the stopper spring urges the stopper in an upward direction so that as the bore of the lockdown member passes over the port, the stopper spring urges the stopper into the bore.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only example embodiments of the invention and are therefore not to be considered limiting of its scope as the invention may admit to other equally effective embodiments.

DETAILED DESCRIPTION

Figure 1:
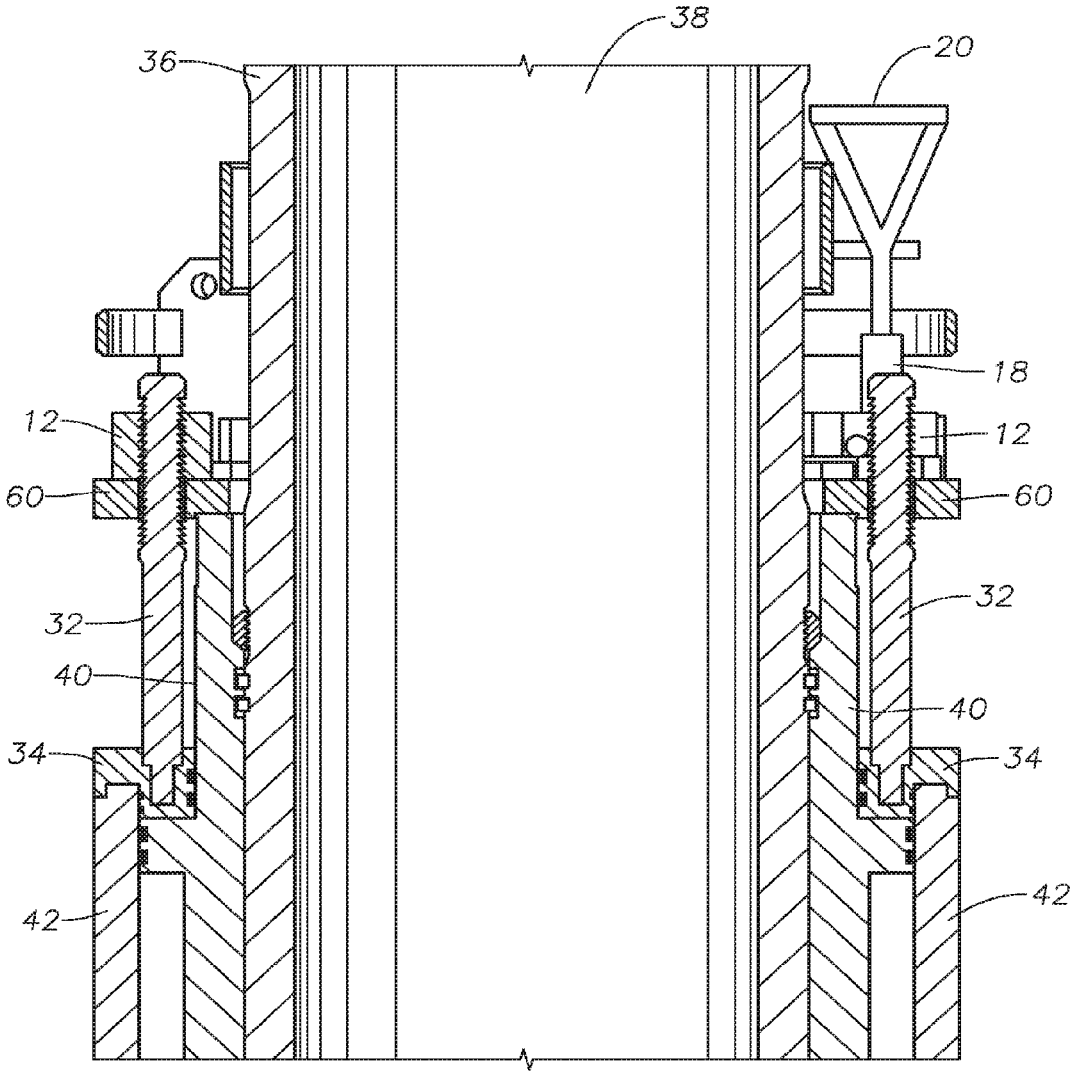
FIG. 1 (PRIOR ART)
FIG. 1 is a cross-sectional view of a subsea wellhead connector assembly with a known mechanical lockdown system.

FIG. 1 illustrates a cross-sectional view of a subsea wellhead connector assembly 50 with a known mechanical lockdown ("MLD") system. The wellhead assembly 50 includes a tieback connector 36 with a bore 38 and an annular ring 60 that circumscribes the outer diameter of the tieback connector 36. The MLD system includes a MLD plate or member 12 and a lock handle 20. The plate 12 has an internal thread profile that engages with an external thread profile of a tie rod 32. A lower end of the tie rod 32 is attached to a connector cap 34, which in turn is secured to a stationary connector body 40, and to a non-stationary outer cylinder 42 of the tieback connector 36 connected to the subsea wellhead assembly 50. The tie rod 32 extends axially upward from the connector assembly 34, 40, 42 of the tieback connector 36 and through the annular ring 60 with at least some of the tie rod profile being located axially above the annular ring 60. A number of MLDs can be spaced around a circumference of the annular ring 60.

Figure 2:
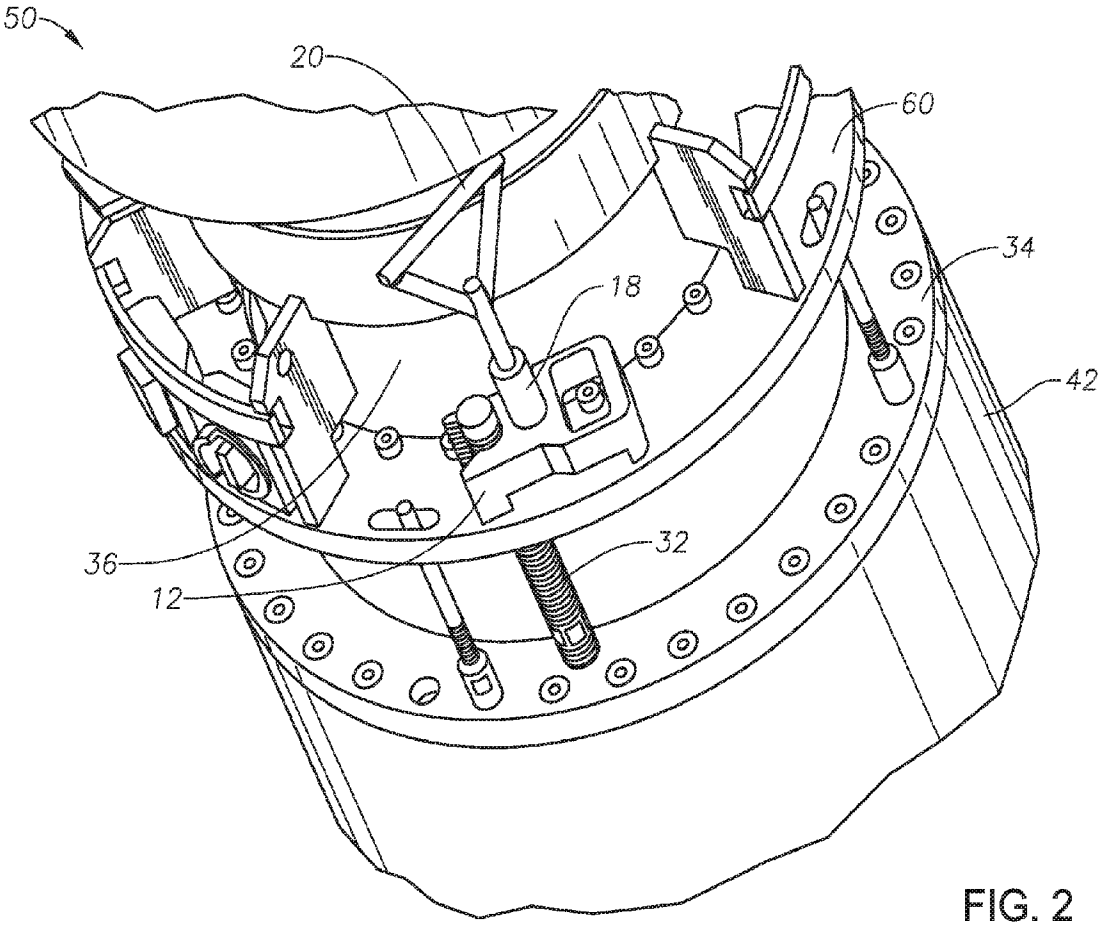
FIG. 2 (PRIOR ART)
FIG. 2 is a perspective view of the subsea wellhead connector assembly illustrated in FIG. 1.

FIG. 2 is a perspective view of the subsea wellhead assembly 50 illustrated in FIG. 1. As illustrated, the annular ring 60 circumscribes the outer diameter of the tieback connector 36. The MLD plate 12 has an internal thread profile that engages with an external thread profile of the tie rod 32. A lower end of the tie rod 32 is attached to the connector cap 34, which in turn is secured to the non-stationary cylinder body 42 of the tieback connector 36 connected to the subsea wellhead assembly 50. The tie rod 32 extends axially upward from the connector assembly 42 of the tieback connector 36 and through the annular ring 60 with at least some of the tie rod profile being located axially above the annular ring 60. As it may be apparent to one of skill in the art, a number of MLDs can be spaced around a circumference of the annular ring 60.

Figure 3B:
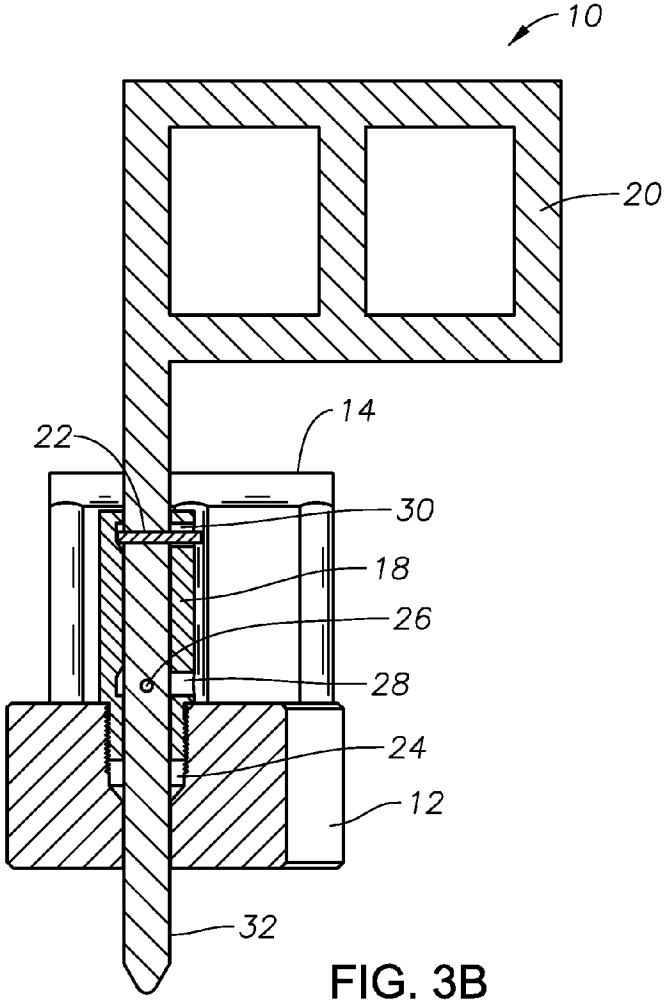
FIG. 3B (Prior Art)
FIG. 3B is a cross sectional view of the lock down assembly shown in FIG. 3A along the sectional line 3B-3B.
Figure 3A:
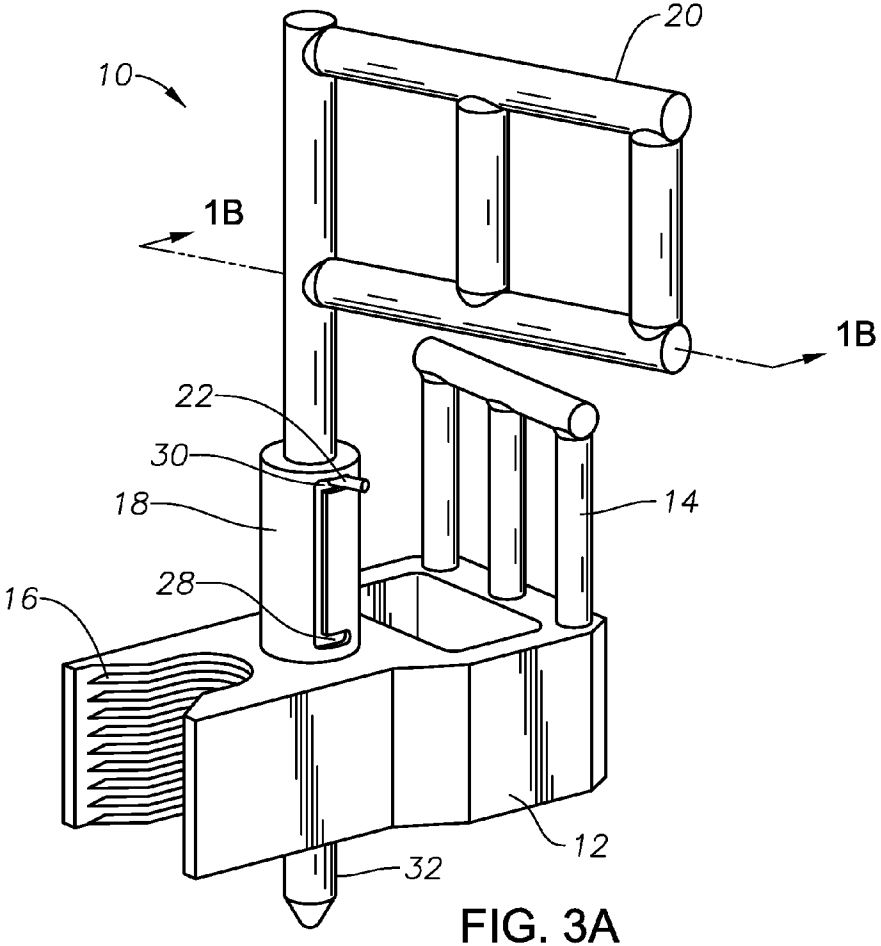
FIG. 3A (Prior Art)
FIG. 3A is a perspective view of a known lock down assembly.

FIG. 3A illustrates in further detail the MLD system of FIGS. 1 and 2. MLD system 10 may include a lockdown member or plate 12 and a locking handle 20. The MLD plate 12 has a recess portion 16 on one end, which includes a mating profile that corresponds with a tie rod profile on the tie rod 32. The other end of the MLD plate 12 has a handle bar 14 that is used by the ROV to carry the system 10. MLD plate 12 also includes a cylindrical slot support 18 with a through slot 24. When the connector assembly has to be locked, the ROV positions the MLD plate 12 such that the through slot 24 is in line with the corresponding slot on the annular ring. Then the ROV would insert a stem 32 of the lock handle 20 into the slot 24 such that the stem is at least partially inserted into the slot on the annular ring. The ROV then inserts lock pins 22, 26 into slots 28, 30 to lock the lock handle 20 in place. FIG. 3B is a cross-sectional view of the MLD system 10 illustrated in FIG. 3A along the line 3B-3B.

In systems similar to the those illustrated in FIGS. 3A and 3B, the ROV had to carry the MLD plates 12, lock handle 20 and lock pins 22, 26 from the surface and install them along the annular ring in order to lockdown the connector assembly. When the connector assembly is unlocked, the ROV had to store these components in a basket of items, and then carry the basket to a storage place and place the MLD components temporarily in the storage place until they were ready to be reused. If any of the MLD components were dropped during transportation, they had to be replaced.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 4:
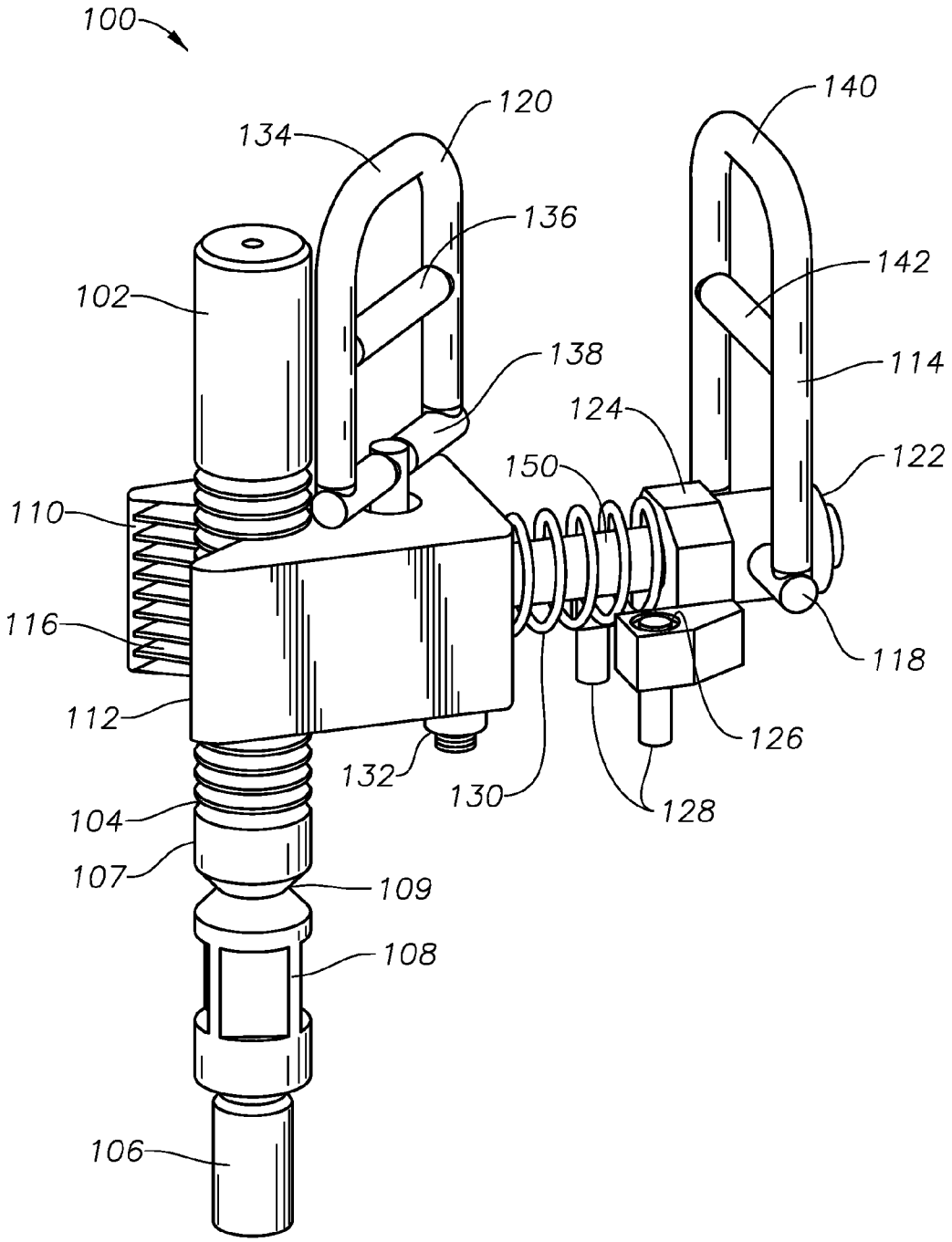
FIG. 4 is a perspective view of a lock down assembly in accordance with one or more example embodiments of the disclosure.

Turning now to FIG. 4, illustrated is an example mechanical lockdown assembly 100 for a wellhead connector, according to one or more example embodiments of the present disclosure. The mechanical lockdown assembly 100 includes a lockdown plate or lockdown member 112. The lockdown member 112 has a vertical recess 110 on one end that includes a lockdown profile 116 for mating with a tie rod profile 104 of a tie rod 102. The recess 110 can be wider at an outer end of the recess 110 in order to allow for greater tolerance in the relative placement of the lockdown member 112 as the lockdown member 112 is being moved to receive the tie rod 102 within the recess 110. The tie rod 102 extends axially upward from a connector assembly (not shown), and through an annular ring 160 (shown in FIG. 5) around the tieback connector, with at least some of the tie rod profile 104 being located axially above the annular ring 160. A number of mechanical lockdown assemblies 100 can be spaced around a circumference of the annular ring 160. The mechanical lockdowns 100 can be a part of the connector assembly and can be carried subsea as part of the connector assembly.

Lockdown assembly 100 may include the tie rod 102. A lower end 106 of the tie rod 102 is attached to a connector cap, which in turn is secured to stationary connector body of a tieback connector (not shown). Tie rod 102 extends in an axially upward direction from connector cap of the tieback connector and passes through a hole in the annular ring 160. Tie rod 102 has a tie rod profile 104 on a tie rod outer diameter of tie rod 102, which may be a set of threads or may include parallel grooves. Tie rod 102 can have two separate axial lengths of tie rod profile 104, or a single continuous length of tie rod profile 104. Lockdown assembly 100 can include a plurality of tie rods 102 spaced around a circumference of stationary connector body of the tieback connector. Each tie rod 102 can have components associated with the tie rod 102, as discussed herein.

A first handle 140 and a second 120 handle are associated with the lockdown member 112. The first handle 140 is connected to the lockdown member 112 by way of a rod 150 that extends radially outward from the lockdown member 112, at an end 122 of the lockdown member 112 opposite the recess 110. One end of the rod 150 is attached to the lockdown member 112 and the other end of the rod 150 is attached to the first handle 140. The rod 150 passes through an opening in a rod support 124 that is located between the lockdown member 112 and the first handle 140 such that the rod 150 can slide back and forth relative to the rod support 124. The rod support 124 is secured to the annular ring 160 using one or more screws 128 that may be inserted through holes 126 in the body of the rod support 124. Therefore, the rod support 124 is fixed to the annular ring 160 and not movable. A rod spring 130 circumscribes the rod 150 and has a first end that engages the lockdown member 112 and a second end that engages the rod support 124. The rod spring 130 urges the first handle 140 in the direction of the lockdown member 112 so that the recess 110 is urged towards, and in engagement with, the tie rod 102. Tie rod 102 may include a first portion 107 with a first diameter and a second portion 108 with a second diameter that may engage with at least part of the connector assembly and separate the two axial lengths of tie rod profile 104.

Figure 7:
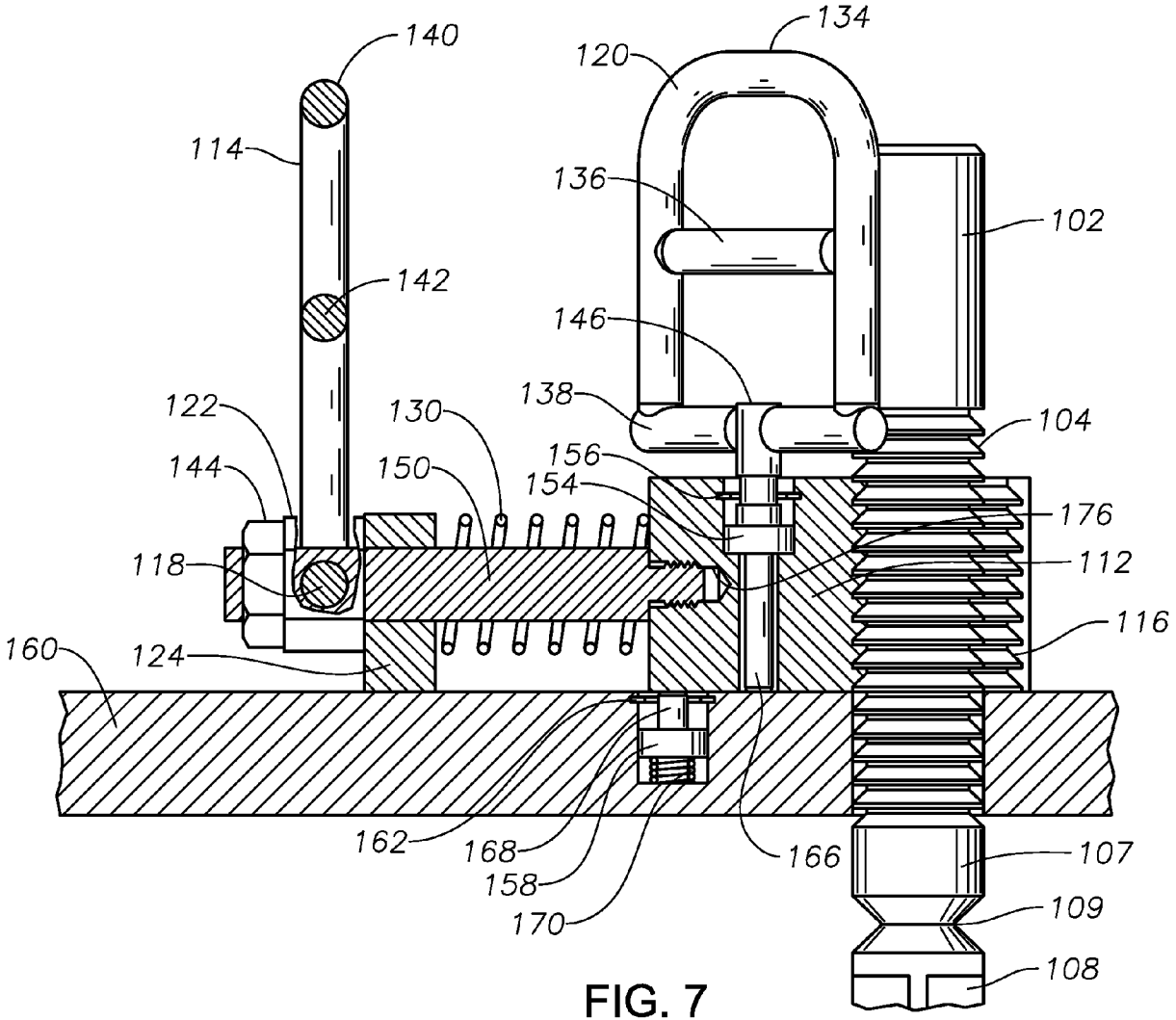
FIG. 7 is a sectional view of the lock down assembly of FIG. 4, shown in a lockdown engaged position, in accordance with one or more example embodiments of the disclosure.

The first handle 140 extends generally axially and perpendicular to the rod 150. The first handle 140 is shaped to be manipulated by a remotely operated vehicle (ROV). In one example embodiment, the first handle 140 has a plurality of handle bars 114, 142, 118, which may be joined together to form the first handle 140. The first handle 140 can be moved radially relative to an axis of the tie rod 102 by the ROV, as will be explained below, to move the mechanical lockdown 112 between an open position where the lockdown profile 116 is spaced apart from the tie rod profile 104, and an engaged position where the lockdown profile 116 engages with the tie rod profile 104. In the open position, which is illustrated in FIG. 5 in further detail, the tie rod 102 can move axially relative to the mechanical lockdown 112 and the annular ring 160, and in the engaged position, which is illustrated in FIG. 7 in further detail, the tie rod 102 is fixed axially relative to the mechanical lockdown 112 and the annular ring 160.

The second handle 120 also extends generally axially and perpendicular to the rod 150. The second handle 120 is shaped to be manipulated by a remotely operated vehicle (ROV) and is fixed relative to pin 166 (shown in FIG. 6). In one example embodiment, the second handle 120 has a plurality of handle bars 134, 136, 138, which may be joined together to form the second handle 120. The second handle 120 can be moved axially as well as radially by the ROV, as will be explained below, to move the mechanical lockdown 112 between an open position where the lockdown profile 116 is spaced apart from the tie rod profile 104, and an engaged position where the lockdown profile 116 engages with the tie rod profile 104. Lockdown assembly 100 may also include a plunger system or spring loaded system 132 that can lock and unlock the second handle 120 as needed. Details of the plunger system or spring loaded system 132 will be described in further detail in FIGS. 5-7.

Figure 5:
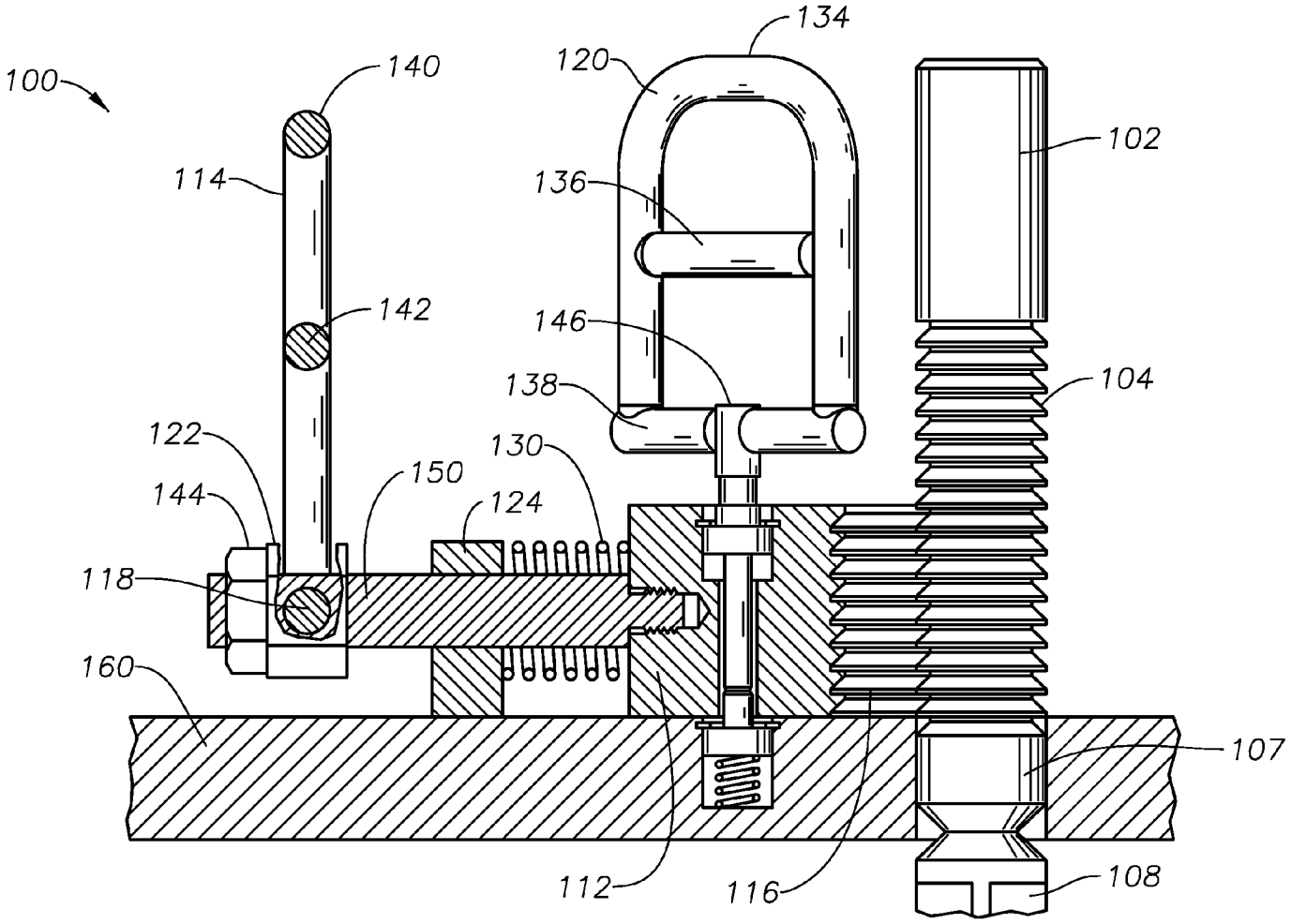
FIG. 5 is a sectional view of the lock down assembly of FIG. 4, shown in a lockdown open position, in accordance with one or more example embodiments of the disclosure.

FIG. 5 illustrates an open position of the lockdown assembly 100 where the lockdown profile 116 is spaced apart from the tie rod profile 104. In the open position, the tie rod 102 can move axially relative to the mechanical lockdown 112 and the annular ring 160.

Figure 6:
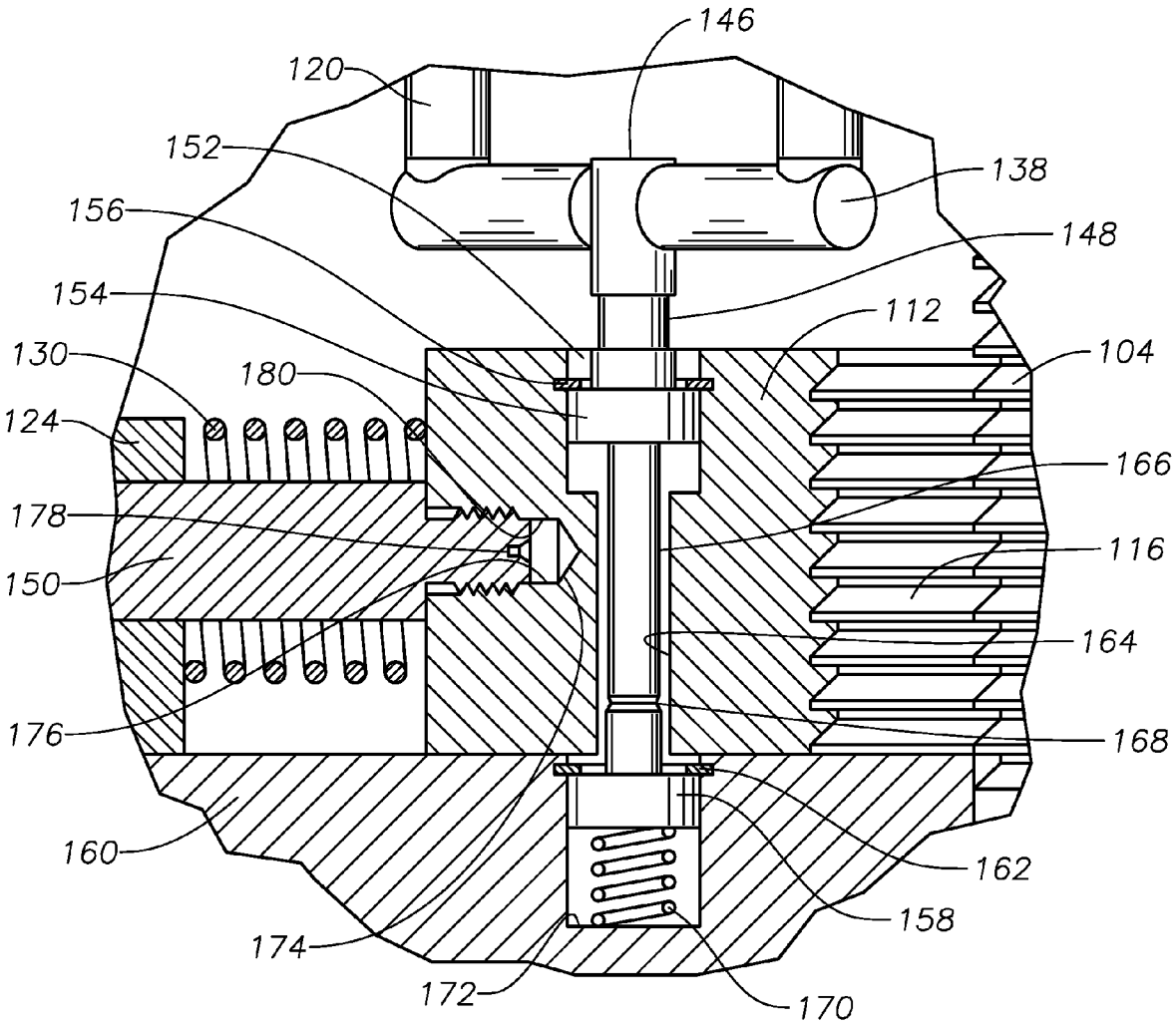
FIG. 6 is a detail view of a portion of the lock down assembly of FIG. 5, in accordance with one or more example embodiments of the disclosure.

Turning now to FIG. 6, which is a detail view of a portion of the lock down assembly 100 of FIG. 5, the second handle 120 has a stem 146 that extends axially through a bore 152 of the mechanical lockdown 112. The second handle 120 extends generally axially, and coaxially with the stem 146. In the open position, a bottom end of the stem 146 is located within the bore or hole 164 in annular ring 160 and a stopper 168 can extend between a snap ring 162 of the annular ring 160 and the bottom of bore 172. The stopper 168 can lock the mechanical lockdown 112 in the open position. A stopper spring 170 is located in the bore 172 and urges the stopper 168 in an upward direction so that as the bore 164 of the lockdown member 112 passes over the snap ring 162, the stopper spring 170 will urge the stopper 168 into the bore 164. Stopper 168 has a larger diameter portion 158 that is closely received in bore hole 172. Spring 170 urges the smaller diameter upper portion of stopper 168 upward to protrude above the flat surface of annular ring 160 as shown, for example, in FIG. 5. The second handle 120 has a visual indicator 148 on the stem 146 so that an operator can visualize the axial position of the second handle 120 to determine if the mechanical lockdown 112 is in a lockdown open position or not.

Rod 150 extends radially outward from the lockdown member 112, and one end of the rod 150 is attached to the first handle 140. The rod 150 engages with the lockdown member 112 via slot 180 that is formed on a side opposite to the profile 116 and in which the threaded end of rod 150 screws into. The rod spring 130 is biased against a flat wall surface of the lockdown member 112 and circumscribes the rod 150. It has a first end that is biased against the lockdown member 112 and a second end that engages the rod support 124. The rod spring 130 urges the lockdown member 112 towards the tie rod 102 so that the recess 110 is urged towards, and in engagement with, the tie rod 102. Hole 180 may have a conical shaped end 174 to avoid damage to other components of the lockdown assembly 100. A distal end 178 of the rod 150 is inserted into the slot 180 and rests on a surface 176 of the slot 180. In a lockdown open position, the rod spring 130 is energized and the stopper 168 stops the lockdown member 112 from engaging with the tie rod 102. In this open position the visual indicator 148 on the stem 146 is clearly seen so that an operator knows the mechanical lockdown 112 is in a lockdown open position. It should be noted, however, that in the open position of FIG. 6, the upper end of stopper 168 enters bore 164 in lockdown member 112 and pushes stem 166 upward. In the engaged position of FIG. 7, handle 120 is pushed downward to push stopper 168 down so that it is no longer in lockdown member bore 164, which allows lockdown 112 to slide toward tie rod 102.

In an alternate embodiment, the stopper 168 can be omitted and a lower portion of the stem 146 can instead be used to retain the mechanical lockdown 112 in the lockdown open position. In such an embodiment, a stem spring (not shown) can circumscribe the stem 146 and urge the stem 146 downward, for example, by engaging an upward facing shoulder 154 of the stem 146 and a downward facing protrusion of the lockdown member 112. When the mechanical lockdown 112 is in the engaged position, the bottom end of the stem 146 will rest on an upper surface of the annular ring 160. As the stem 146 passes over the bore 172, the stem spring can urge the lower portion of the stem 146 into the bore 172 and lock the mechanical lockdown 112 in the lockdown open position.

FIG. 7 illustrates an engaged position of the mechanical lockdown assembly 100, according to one or more example embodiments of the present disclosure. In an engaged position 300, a bottom end 166 of the stem 146 rests on a top surface of the annular ring 160. When the mechanical lockdown member 112 is in the engaged position, the stopper 168 will be located within the hole 172 and a bottom surface of the mechanical lockdown 112 will block the hole 172 so that the stopper 168 is retained within the hole 172.

The tie rod 102 can have a shear groove 109 located axially below the annular ring 160. The shear groove 109 is a region of reduced diameter of the tie rod 102. In the engaged position, the mechanical lockdown 112 can prevent movement of the annular ring 160 and mechanical lockdown 112 relative to the tie rod 102 and connector assembly. However, if the connector assembly is pressurized to unlock the connector assembly, with the mechanical lockdown 112 in an engaged position, the tie rod 102 will shear at the shear groove 109 before other components, such as parts of the connector assembly, are damaged. The mechanical lockdown assembly 100 could then be retrieved, the tie rod 102 replaced, and the mechanical lockdown 112 assembly re-attached to the connection assembly.

In an example of operation, when the mechanical lockdown 112 is in the engaged position, the ROV can pull the first handle 140 radially outward to move the lockdown profile 116 away from the tie rod profile 104 so that the mechanical lockdown 112 is in an open position. As the bore 164 passes over hole 172 while lockdown member 112 is sliding on annular ring 160, stopper 168 moves upward into engagement with bore 164 in lockdown 112. Stopper 168 then pushes up stem 166, which moves handle 120 upward. Indicator 148 will then show that handle 120 is in the open position. The ROV can then release the first handle 140 and the mechanical lockdown 112 will remain in the lockdown open position. The mechanical lockdown 112 can then be moved relative to the tie rod 102.

In order to move the mechanical lockdown 112 back to an engaged position, the ROV can press axially downward on the second handle 120. This will cause the stopper 168 to be pressed back down into the hole 172. The mechanical lockdown 112 will then be urged by the rod spring 130 towards the tie rod 102 so that the lockdown profile 116 engages the tie rod profile 104. This process of moving the mechanical lockdown 112 between an engaged and open position can be repeated as often as desired or necessary. Additionally, the mechanical lockdown is permanently mounted to the connector assembly and is reusable with minimal ROV interface.

Therefore, embodiments of this disclosure can provide a mechanical backup for preventing, for example, a tie back connector from being disconnected from a wellhead high pressure housing when tension and bending loads are imposed. This increases the overall reliability of the connector. Systems and methods of this disclosure can also serve as a mechanical fuse, avoiding damage on other expensive components, for example, if a main piston of the connection assembly creeps or is moved towards an unlocked position with the mechanical lockdown in an engaged position. Embodiments of this disclosure are entirely mechanical and do not require redundant hydraulic controls, which allows the equipment to be considered a low risk-level category. The mechanical lockdown can move between an engaged and an open position by the ROV in place so that there is no need to pull a riser or connector out to the surface to reset the lockdown, and the ROV's usage time can be minimized, which results direct cost savings for the operator.

The terms "vertical", "horizontal", "upward", "downward", "above", and "below" and similar spatial relation terminology are used herein only for convenience because elements of the current disclosure may be installed in various relative positions.

The system and method described herein, therefore, are well adapted to carry out the objects and attain the ends and advantages mentioned, as well as others inherent therein. While example embodiments of the system and method have been given for purposes of disclosure, numerous changes exist in the details of procedures for accomplishing the desired results. These and other similar modifications will readily suggest themselves to those skilled in the art, and are intended to be encompassed within the spirit of the system and method disclosed herein and the scope of the appended claims.

What is claimed is:

1. A lockdown system for a subsea wellhead connector connecting a tubular member to a subsea wellhead assembly, the lockdown system comprising:

a tie rod extending in an axial direction from a stationary connector body of a tieback connector through a lockdown support member circumscribing the tubular member, the tie rod having a tie rod profile on a tie rod outer diameter;

a lockdown member with an inner diameter profile corresponding to the tie rod profile, the lockdown member being moveable between a lockdown open position where the member is spaced radially outward from the tie rod, and a lockdown engaged position where the inner diameter profile engages the tie rod profile to axially couple the stationary connector body and the lockdown support member, the lockdown support member including a stopper that engages an engagement feature in the lockdown member as the engagement feature passes over the stopper; and a lockdown member rod extending radially outward relative to an axis of the tie rod profile, the lockdown member rod adapted to move the lockdown member from the lockdown open position to the lockdown engaged position, wherein the lockdown member rod is supported by a lockdown member rod support that is adapted to be secured to the lockdown support member circumscribing the tubular member.

2. The lockdown system according to claim 1, further comprising a first handle installed on one end of the lockdown member rod, the first handle being perpendicular to the lockdown member rod such that a radially outward movement of the first handle relative to the lockdown member rod support moves the lockdown member from the lockdown engaged position to the lockdown open position; and a lockdown member rod spring circumscribing the lockdown member rod, the lockdown member rod spring having a first end that engages the lockdown member and a second end that engages the lockdown member rod support, thereby biasing the lockdown member away from the lockdown member rod support.

3. The lockdown system according to claim 1, further comprising a second handle having a stem that is inserted in a through bore formed parallel to the axis of the lockdown member.

4. The lockdown system according to claim 1, wherein the engagement feature includes a bore, and wherein the lockdown support member comprises a stopper spring located in a port, wherein the stopper spring urges the stopper in an upward direction so that as the bore of the lockdown member passes over the port, the stopper spring urges the stopper into the bore.

5. The lockdown system according to claim 3, wherein the second handle comprises a visual indicator on the stem to determine if the lockdown member is in the lockdown open position or the lockdown engaged position.

6. The lockdown system according to claim 1, wherein the lockdown member comprises a recess portion having a wider opening leading away from the inner diameter profile.

7. The lockdown system according to claim 1, wherein the subsea wellhead connector has a plurality of tie rods spaced around a circumference of the lockdown member support.

8. A lockdown assembly for a subsea wellhead connector connecting a tubular member to a subsea wellhead assembly, the lockdown assembly comprising:

a tie rod extending in an axial direction from a stationary connector body of a tieback connector through an annular ring circumscribing the tubular member, the tie rod having a tie rod profile on a tie rod outer diameter;

a lockdown member with an inner diameter profile corresponding to the tie rod profile, the lockdown member being moveable between a lockdown open position where the member is spaced radially outward from the tie rod, and a lockdown engaged position where the inner diameter profile engages the tie rod profile to axially couple the stationary connector body and the annular ring, the lockdown member being slidable on the annular ring, the annular ring including a stopper that engages an engagement feature in the lockdown member as the engagement feature passes over the stopper; and a rod extending radially outward from the lockdown member, the rod adapted to move the lockdown member from the lockdown open position to the lockdown engaged position, wherein the rod is supported by a rod support that is secured to the annular ring circumscribing the tubular member.

9. The lockdown assembly according to claim 8, further comprising a first handle installed on one end of the rod, the first handle being perpendicular to the rod such that a radially outward movement of the first handle moves the lockdown member from the lockdown engaged position to the lockdown open position; and a rod spring circumscribing the rod, the rod spring having a first end that engages the lockdown member and a second end that engages the rod support, thereby biasing the lockdown member away from the rod support.

10. The lockdown assembly according to claim 8, further comprising a second handle having a stem that is inserted in a through bore formed on one surface of the lockdown member.

11. The lockdown assembly according to claim 8, wherein the engagement feature includes a bore, and wherein the annular ring comprises a stopper spring located in a port, wherein the stopper spring urges the stopper in an upward direction so that as the bore of the lockdown member passes over the port, the stopper spring urges the stopper into the bore.

12. The lockdown assembly according to claim 10, wherein the second handle comprises a visual indicator on the stem to determine if the lockdown member is in the lockdown open position or the lockdown engaged position.

13. The lockdown assembly according to claim 8, wherein the lockdown member comprises a recess portion having a wider opening on one end and the inner diameter profile on the other end.

14. The lockdown assembly according to claim 8, wherein the subsea wellhead connector has a plurality of tie rods spaced around a circumference of the stationary connector body.

15. A method of connecting a tubular member to a subsea wellhead assembly having a tie rod extending along an axis from a stationary connector body of a tieback connector, the tie rod having a tie rod profile on a tie rod outer diameter, the method comprising:

mounting an annular ring to the stationary connector body with the tie rod extending through the annular ring;

mounting a lockdown member with an inner diameter profile corresponding to the tie rod profile on the annular ring, the lockdown member being moveable between a lockdown open position where the member is spaced radially outward from the tie rod, and a lockdown engaged position where the inner diameter profile engages the tie rod profile to axially couple the stationary connector body and the annular ring, the annular ring including a stopper that engages an engagement feature in the lockdown member as the engagement feature passes over the stopper;

extending a rod radially outward from the lockdown member, the rod adapted to move the lockdown member from the lockdown open position to the lockdown engaged position, wherein the rod is supported by a rod support that is secured to the annular ring circumscribing the tubular member; and pulling the rod radially outward to radially move the lockdown member relative to the annular ring.

16. The method according to claim 15, further comprising:

providing a first handle on one end of the rod, the first handle being perpendicular to the rod such that a radially outward movement of the first handle moves the lockdown member from the lockdown engaged position to the lockdown open position; and providing a rod spring circumscribing the rod, the rod spring having a first end that engages the lockdown member and a second end that engages the rod support, thereby creating biasing the lockdown member away from the rod support.

17. The method according to claim 15, further comprising:

inserting a stem of a second handle into a through bore formed on one surface of the lockdown member.

18. The method according to claim 15, further comprising:

providing the annular ring with a hole configured to receive a stopper spring, wherein the stopper spring urges the stopper in an upward direction so that as a bore of the lockdown member passes over the hole, the stopper spring urges the stopper into the bore.

19. The method according to claim 17, further comprising:

providing the second handle with a visual indicator on the stem to determine if the lockdown member is in the lockdown open position or the lockdown engaged position.

20. The method according to claim 15, further comprising:

providing the lockdown member with a recess portion having a wider opening on one end and the inner diameter profile on the other end.

* * * * *